US005778679A

United States Patent [19]

Celorier, Jr. et al.

[11] Patent Number: 5,778,679

[45] Date of Patent: Jul. 14, 1998

[54] METHOD AND APPARATUS FOR INCREASING ACCEPTANCE AND ADJUSTING THE RATE OF PRESSURE VARIATIONS WITHIN A PRESPECIFIED RANGE IN PRECHARGED FLUID STORAGE SYSTEMS

[75] Inventors: George M. Celorier, Jr., Franklin; Joseph Gerstmann, Framingham, both of Mass.

[73] Assignee: Amtrol Inc.

[21] Appl. No.: 739,051

[22] Filed: Oct. 28, 1996

[51] Int. Cl.[6] ..... F17C 5/02

[52] U.S. Cl. ..... 62/47.1; 62/53.1

[58] Field of Search ..... 62/47.1, 53.1

[56] References Cited

U.S. PATENT DOCUMENTS

| | | | |
|---|---|---|---|
| 3,169,670 | 2/1965 | Hrebenak et al. . | |
| 3,272,238 | 9/1966 | Groppe . | |
| 3,524,475 | 8/1970 | Kirk, Jr. . | |
| 3,727,418 | 4/1973 | Glazier | 62/53.1 |
| 3,798,919 | 3/1974 | Hershner | 62/53.1 |
| 3,853,157 | 12/1974 | Madaio . | |
| 4,146,066 | 3/1979 | Dietrich et al. . | |
| 4,174,741 | 11/1979 | Parsons et al. . | |
| 4,328,843 | 5/1982 | Fugii . | |
| 4,346,743 | 8/1982 | Miller . | |
| 4,913,197 | 4/1990 | Friedrich . | |
| 5,345,980 | 9/1994 | Burt et al. . | |
| 5,386,925 | 2/1995 | Lane . | |

*Primary Examiner*—Ronald C. Capossela
*Attorney, Agent, or Firm*—Joseph J. Kaliko

[57] ABSTRACT

Methods and apparatus for (a) increasing expansion tank "acceptance" (defined herein as working fluid storage capacity); and (b) adjusting the rate of pressure variations within a prespecified range in precharged fluid storage systems (for example, holding pressure down below a prespecified threshold value for a given volume of acceptance, stored water temperature level, etc.). A "volatile" fluid (defined herein as a fluid having a boiling point within the predetermined pressure and temperature operating ranges for a given system), is used at least in part as the expansion fluid in an expansion tank included in a fluid storage system. The volatile fluid, whether pure or combined with an ideal gas to temper the expansion fluids sensitivity to temperature, can be used to realize a relatively constant pressure "vapor spring" to make internal expansion tank pressure relatively independent of acceptance (where the term "relatively" in each instance is referring to a comparison between the use of an expansion fluid that contains a volatile liquid and one that does not contain such fluid).

40 Claims, 11 Drawing Sheets

POTENTIAL APPLICATIONS FOR CONSTANT PRESSURE EXPANSION TANKS

| APPLICATION | MIN P | MAX P | TMIN | TYP | TMAX | TYPE | POTABLE |
|---|---|---|---|---|---|---|---|
| R/O RESIDENTIAL | 5 | LINE | 55 | 65–85 | 100 | INVENTORY | YES |
| HYDRONIC RESIDENTIAL | 12 | 30 | 40 | 80–120 | 140 | CUSHION | MAYBE |
| WELL SYSTEM | 40 | 60 | 55 | 55–65 | 70 | INVENTORY | YES |

FIG. 5

METHOD AND APPARATUS FOR INCREASING ACCEPTANCE AND ADJUSTING THE RATE OF PRESSURE VARIATIONS WITHIN A PRESPECIFIED RANGE IN PRECHARGED FLUID STORAGE SYSTEMS

BACKGROUND OF THE INVENTION

1. Field of the Invention

The invention generally relates to fluid storage systems such as, for example, systems used for storing drinking water (including both reverse osmosis ("RO") and well storage systems), hydronic systems which store hot water for heating purposes, chilled water storage systems, water treatment systems, and the like.

More particularly, the invention relates to expansion and storage tanks (hereinafter collectively referred to as expansion tanks), typically used in the aforementioned exemplary systems to store fluid under pressure; and specifically to methods and apparatus for (a) increasing expansion tank "acceptance" (defined herein as working fluid storage capacity); and (b) adjusting the rate of pressure variations within a prespecified range in precharged fluid storage systems (for example, holding pressure down below a prespecified threshold value for a given volume of acceptance, stored water temperature level, etc.).

The term "working fluid" is defined herein as the product fluid, e.g., the drinking water itself in an RO system, the hot water in a hot water heating system, etc.; as opposed to an "expansion fluid" which is a fluid that expands and contracts and exists only in an expansion tank (i.e., is not intended for delivery to a customer or to mix with the working fluid), such as a fluid used to precharge the expansion tank.

2. Description of the Related Art

Expansion tanks used in fluid storage systems are well known by those skilled in the art. Typically, expansion tanks are divided into two sections (or portions): one that may be precharged with a fluid under pressure, for example, a gas such as air from a first fluid source; and the other being connected to a second fluid source, for example, the hot water source in a hot water heating system.

Examples of expansion tanks may be seen in U.S. Pat. No. 3,524,475 (incorporated herein by reference); U.S. Pat. No. 5,386,925, assigned to the same assignee as the instant invention (incorporated herein by reference); and U.S. patent application Ser. No. 08/602,249, filed Feb. 15, 1996, assigned to the same assignee as the instant invention (incorporated herein by reference).

The tanks described in the incorporated references all use a deformable diaphragm to divide the tank into the aforementioned two sections. The pressure in the precharged section varies with temperature and as the diaphragm is displaced to accommodate variations in the volume (or temperature) of a fluid (e.g., water) being stored in the other section.

When, for example, the expansion tank is incorporated in a hot water heating system (having a fixed mass of hot water within the system), the variation in volume is caused when the boiler water is heated and cooled in the normal cyclic operation of the heating system.

If the expansion tank is a part of a water storage system, the variation in volume occurs as tap water is drawn and when the pump operates to replace the water drawn from the tank. The diaphragms called for in the exemplary incorporated prior art separate the expansion fluid stored in one section of the tank, from the working fluid stored in the other section of the tank.

One of the drawbacks of current expansion tank design is the limitation of acceptance volume as a result of pressure build-up as fluid expands into the tank. This would not be a problem if the pressure was allowed to increase to any level. Practical considerations, however, such as pressure relief devices and system component integrity, limit the maximum acceptance volume.

For example, an expansion tank having an initial charge of 5 psig and a maximum pressure limit, due to a, relief valve of 30 psig, will have an acceptance of about 56 percent. Thus about half the tank volume is wasted, requiring an oversized, more expensive tank than theoretically necessary.

In one special case involving reverse osmosis (RO) systems, the build-up of pressure in the tank reduces the efficiency of upstream water purification processes. As those skilled in the art will readily appreciate, the amount of water purified by, for example, an upstream membrane, is a strong function of the pressure drop across the membrane. A good recovery rate (for the purification process) for a residential system would be 25 percent. Since the process is slow and typical recoveries are one gallon per hour, a storage system is needed.

One of the best systems available for the RO application is the diaphragm expansion tank (such as those described in the incorporated references). The drawback is that at 5 psig the recovery rate may be 25% at a supply pressure of 60 psig; however, by the end of the storage cycle the tank pressure may be 40 psig with the recovery rate falling to approximately 8 percent (a poor recovery rate).

Attempts to solve this problem typically focus on the use of electric and hydraulic pumps and valves to allow storage at low pressure.

In view of the prior art it would be desirable to provide methods and apparatus for use in fluid storage systems that do not require the use of additional equipment, such as the aforementioned pumps and valves, to solve the pressure, acceptance and recovery rate problems explained hereinabove with reference to the exemplary RO fluid storage system.

More particularly, it would be desirable to provide to an expansion tank within which the internal tank pressure, after being charged at some predetermined minimum required pressure, can be maintained within a predefined acceptable pressure range (as the tank goes from minimum to maximum acceptance) which enables a greater percentage of the entire tank volume to be used for storage than in conventional fluid storage systems.

More generally, it would be desirable to provide methods and apparatus for increasing the working fluid storage capacity of precharged fluid storage systems; and for holding down pressure increases in precharged fluid storage systems for a given volume of acceptance.

In line with the aforestated desires, it would be desirable to provide methods and apparatus for realizing a "vapor spring" for use in a fluid storage system, where the vapor spring utilizes something other than an ideal gas as an expansion fluid (ideal gases being typically used in conventional fluid storage systems) to: (a) increase the amount of working fluid that can be stored in a fluid containment vessel at a given pressure at ambient system operating temperature when compared with the amount of working fluid that could be accepted in such a vessel if an ideal gas expansion fluid had been used to pre-charge the vessel; and (b) reduce pressure increases in a fluid containment vessel for a given volume of acceptance at ambient system operating temperature when compared with the use of an ideal gas expansion fluid in the vessel for the given volume of acceptance.

Further yet, it would be desirable to provide processes for adjusting the rate of pressure change, within a fluid containment vessel, within a prespecified pressure range at ambient temperature, as the volume of working fluid stored in the vessel changes; and for adjusting the rate of pressure change, within a fluid containment vessel, within a prespecified pressure range at ambient temperature, as the temperature of working fluid stored in the vessel changes.

SUMMARY OF THE INVENTION

Accordingly, it is a general object of the invention to provide improved expansion tanks for use in hot water heating systems, pressurized water systems, and the like.

It is a further general object of the invention to provide methods and apparatus for use in fluid storage systems that do not require the use of additional equipment, such as the aforementioned pumps and valves, to solve the pressure, acceptance and recovery rate problems.

Further yet, it is a general object of the invention to provide methods and apparatus for increasing the working fluid storage capacity of precharged fluid storage systems; and for holding down pressure increases in precharged fluid storage systems for a given volume of acceptance.

More particularly, it is an object of the invention to provide to an expansion tank within which the internal tank pressure, after being charged at some predetermined minimum required pressure, can be maintained within a predefined acceptable pressure range (as the tank goes from minimum to maximum acceptance) which enables a greater percentage of the entire tank volume to be used for storage than in conventional fluid storage systems.

Furthermore, it is a specific object of the invention to provide methods and apparatus for realizing the aforementioned "vapor spring" utilizing something other than an ideal gas as an expansion fluid to: (a) increase the amount of working fluid that can be stored in a fluid containment vessel at a given pressure at ambient system operating temperature when compared with the amount of working fluid that could be accepted in such a vessel if an ideal gas expansion fluid had been used to pre-charge the vessel; and (b) reduce pressure increases in a fluid containment vessel for a given volume of acceptance at ambient system operating temperature when compared with the use of an ideal gas expansion fluid in the vessel for the given volume of acceptance.

Still further, it is an object of the invention to provide (a) a process for adjusting the rate of pressure change, within a fluid containment vessel, within a prespecified pressure range at ambient temperature, as the volume of working fluid stored in the vessel changes; and (b) a process for adjusting the rate of pressure change, within a fluid containment vessel, within a prespecified pressure range at ambient temperature, as the temperature of working fluid stored in the vessel changes.

According to the invention, a "volatile" fluid (defined herein as a fluid having a boiling point within the predetermined pressure and temperature operating ranges for a given system), is used at least in part as the expansion fluid in an expansion tank included in a fluid storage system; as opposed to the utilization of a pure ideal gas expansion fluid, such as air (where an ideal gas is any substance that has the equation of state pressure times specific volume equalling temperature times a constant), as is used in conventional expansion tanks.

The volatile fluid, whether pure or combined with an ideal gas to temper the expansion fluids sensitivity to temperature, can be used to realize a relatively constant pressure "vapor spring" to make internal expansion tank pressure relatively independent of acceptance (where the term "relatively" in each instance is referring to a comparison between the use of an expansion fluid that contains a volatile liquid and one that does not contain such fluid); and realize the objectives stated hereinbefore.

More particularly, the invention is directed, according to a first aspect of thereof, to a method for increasing the working fluid storage capacity of a precharged fluid storage system, wherein the system includes a fluid containment vessel, flexible means for separating the interior of the vessel into (a) a first portion for storing an expansion fluid used to precharge the vessel at ambient temperature to a predetermined back pressure exerted on the means for separating and into (b) a second portion for storing the working fluid, comprising the steps of: (a) precharging the vessel by introducing a volatile expansion fluid into the first portion of the vessel; and (b) introducing the working fluid into the second portion of the vessel to displace the means for separating and cause the volatile expansion fluid to at least in part condense to reduce the increase of the back pressure of the volatile expansion fluid on the means for separating in comparison with the back pressure that would be exerted on the means for separating using an ideal gas expansion fluid, to thereby permit additional working fluid to be introduced into the vessel.

A further aspect of the invention is directed to a method for holding down pressure increases in a precharged fluid storage system for a given volume of acceptance, wherein the system includes a fluid containment vessel, flexible means for separating the interior of the vessel into (a) a first portion for storing an expansion fluid used to precharge the vessel at ambient temperature to a predetermined back pressure exerted on the means for separating and into (b) a second portion for storing the working fluid, comprising the steps of: (a) precharging the vessel by introducing a volatile expansion fluid into the first portion of the vessel; and (b) introducing the working fluid into the second portion of the vessel to displace the flexible means for separating and cause the volatile expansion fluid to at least in part condense and exert a back pressure on the means for separating which is less than the back pressure that would be exerted on the means for separating by an ideal gas expansion fluid for the volume of working fluid accepted, to thereby hold down pressure increases in the vessel for a given volume of acceptance.

According to alternate embodiments of these first two aspects of the invention, the foregoing methods may further comprise the step of combining the volatile expansion fluid with a predetermined amount of an ideal gas (such as air) to modulate the boiling point of the expansion fluid. This would enable a desired back pressure to be achieved if, for example, the vapor pressure of the volatile fluid does not equal the desired back pressure or if is desired to have the back pressure increase slightly with acceptance, etc.

Additional alternate embodiments of the invention, which may be used depending on the application of the invention, contemplate using a refrigerant as the aforementioned volatile expansion fluid; utilizing a non-toxic volatile expansion fluid; and/or using a non-flammable volatile expansion fluid.

Another aspect of the invention is directed to apparatus for increasing the working fluid storage capacity of a precharged fluid storage system, comprising: (a) a fluid containment vessel; (b) flexible means for separating the interior of the vessel into (1) a first portion for storing an expansion fluid used to precharge the vessel at ambient temperature to a predetermined back pressure exerted on the means for separating and into (2) a second portion for storing the working fluid; (c) a volatile expansion fluid located in the first portion of the vessel; and (d) a working fluid located in the second portion of the vessel which displaces the means for separating to cause the volatile expansion fluid to at least in part condense and act as a pressure spring to reduce the increase of the back pressure of the volatile expansion fluid on the means for separating in comparison with the back pressure that would be exerted on the means for separating using an ideal gas expansion fluid, to thereby permit additional working fluid to be introduced into the vessel.

A still further aspect of the invention is directed to apparatus for holding down pressure increases in a precharged fluid storage system for a given volume of acceptance, comprising: (a) a fluid containment vessel; (b) flexible means for separating the interior of the vessel into (1) a first portion for storing an expansion fluid used to precharge the vessel at ambient temperature to a predetermined back pressure exerted on the means for separating and into (2) a second portion for storing the working fluid; (c) a volatile expansion fluid located in the first portion of the vessel; and (d) a working fluid located in the second portion of the vessel which displaces the means for separating to cause the volatile expansion fluid to at least in part condense and act as a pressure spring to exert a back pressure on the means for separating which is less than the back pressure that would be exerted by an ideal gas expansion fluid for the volume of working fluid accepted, to thereby hold down pressure increases in the vessel for a given volume of acceptance.

Further alternate embodiments of the invention (from the apparatus perspective), which may be used depending on the application of the invention, contemplate the expansion fluid being a combination of a volatile fluid and a predetermined amount of an ideal gas (such as air) to modulate the boiling point of the fluid combination; the expansion fluid being (at least in part) a refrigerant; the volatile expansion fluid being non-toxic volatile and/or non-flammable.

Those skilled in the art will readily appreciate that the invention may be practiced and used in a wide variety of fluid storage systems including, without limitation, "inventory storage" systems, examples of which include reverse osmosis systems and well water storage systems; and in "cushioned storage" system, such as hydronic storage systems and chilled water storage system.

The invention may be further characterized as a precharged fluid storage system, comprising: (a) a fluid containment vessel for separately storing both a working fluid and an expansion fluid within the vessel; and (b) a pressure vapor spring that utilizes a volatile expansion fluid to permit additional working fluid to be introduced into the vessel at a given pressure when compared with the amount of working fluid that could be accepted using an ideal gas expansion fluid at the given pressure; while still another aspect of the invention may be characterized as a precharged fluid storage system, comprising: (a) a fluid containment vessel for separately storing both a working fluid and an expansion fluid within the vessel; and (b) a pressure vapor spring that utilizes a volatile expansion fluid to reduce pressure increases within the vessel for a given volume of acceptance when compared with the use of an ideal gas expansion fluid in the vessel for the given volume of acceptance.

The invention may also be characterized as a process for adjusting the rate of pressure change, within a fluid containment vessel, within a prespecified pressure range at ambient temperature, as the volume of working fluid stored in the vessel changes, comprising the steps of: (a) separating the interior of the vessel into two portions utilizing a flexible means for separating; (b) precharging the fluid containment vessel by introducing at least some volatile expansion fluid into one of the interior portions of the vessel; and (c) introducing a working fluid into the other interior portion of the vessel to displace the means for separating and cause the volatile expansion fluid to at least in part condense to reduce the increase of the back pressure of the volatile expansion fluid on the means for separating as the volume of working fluid increases.

Alternate embodiments of the aforestated processes may further comprise the steps of removing working fluid from the other interior portion of the vessel to relax displacement of the means for separating and cause the volatile expansion fluid to at least in part boil; combining the volatile expansion fluid with a predetermined amount of an ideal gas to modulate the boiling point of the expansion fluid; using a volatile fluid that is (at least in part) a refrigerant, non-toxic and/or non-flammable.

Finally, the invention also be characterized as a process for adjusting the rate of pressure change, within a fluid containment vessel, within a prespecified pressure range at ambient temperature, as the temperature of working fluid stored in the vessel changes, comprising the steps of: (a) separating the interior of the vessel into two portions utilizing a flexible means for separating; (b) precharging the fluid containment vessel by introducing at least some volatile expansion fluid into one of the interior portions of the vessel; and (c) introducing a working fluid into the other interior portion of the vessel to displace the means for separating and cause the volatile expansion fluid to at least in part condense to reduce the increase of the back pressure of the volatile expansion fluid on the means for separating as the temperature of the working fluid introduced increases.

This last characterization of the invention (i.e., a process for adjusting the rate of pressure change, within a fluid containment vessel, etc.) may also include the step of lowering the temperature of the working fluid to relax displacement of the means for separating and cause the volatile expansion fluid to at least in part boil.

The invention, as exemplified by the various aspects and characterizations thereof described hereinabove, features the ability to increase expansion tank acceptance while maintaining internal tank pressure within limits that will not affect tank integrity, will not trigger pressure relief mechanisms, etc.

Furthermore the invention solves the aforementioned recovery rate problem in RO systems without having to resort to the use of electric or hydraulic pumps and/or valves to facilitate fluid storage at low pressure.

These and other objects, embodiments and features of the present invention and the manner of obtaining them will become apparent to those skilled in the art, and the invention itself will be best understood by reference to the following Detailed Description read in conjunction with the accompanying Drawing.

BRIEF DESCRIPTION OF THE DRAWING

FIG. 5 is a table that lists three exemplary applications in which the instant invention may be beneficially put to use.

In FIG. 9 the quantity of 245*fa* is kept constant at 0.175 pounds; while the quantity of air varies from 0.005 to 0.010 pounds. There are two sets of curves in FIG. 9, one set corresponding to zero percent acceptance and the other to 90 percent acceptance.

DETAILED DESCRIPTION

Figure 1:
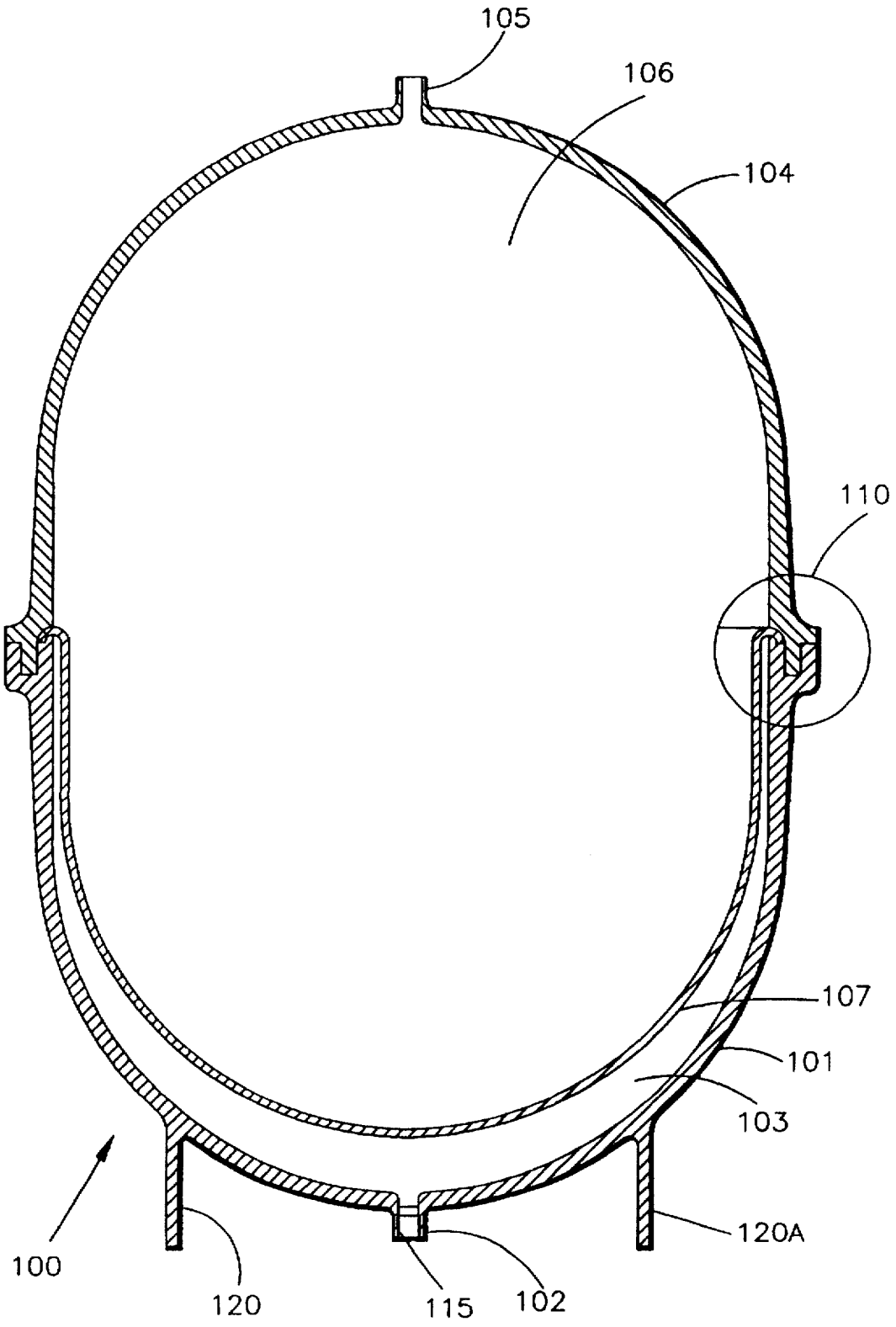
FIG. 1 is a vertical cross-section view of an exemplary expansion tank within which the teachings of the invention may be practiced.

Reference should now be made to FIG. 1 which is presented for background purposes and shows a vertical cross-section view of an exemplary expansion tank within which the teachings of the invention may be practiced.

Tank 100 is the subject of the invention in copending patent application Ser. No. 08/602,249, filed Feb. 15, 1996 now abandoned, assigned to the same assignee as the instant invention (previously incorporated herein by reference); and is only intended to define one environment (an inventory system type expansion tank which could, for example, be used in a reverse osmosis storage system), of the many environments in which the benefits of the instant invention may be realized.

Illustrative expansion tank 100 is shown in FIG. 1 to include a first molded plastic tank section 101, integrally including first connection means 102, for enabling fluid from a first fluid source (not shown) to be placed in fluid communication with a first interior portion 103 of expansion tank 100; and (b) a second molded plastic tank section 104, which when joined together with first molded plastic tank section 101 forms the expansion tank fluid containment vessel 100, integrally including second connection means 105 for enabling fluid from a second fluid source (not shown) to be placed in fluid communication with a second separate interior portion 106 of expansion tank 100.

First connection means 102 an d second connection means 105 provide passageways through which fluid from the first and second fluid sources respectively, may be introduced into and may be withdrawn from expansion tank 100.

According to one embodiment of the invention described in incorporated patent application Ser. No. 08/602,249 now abandoned, first connection means 102 and second connection means 105 are threaded (as shown for example at 115 in FIG. 1) to permit easy installation of valves (not shown) into the depicted passageways. Exemplary tank 100 shown in FIG. 1 also includes tank stand member 120 (and corresponding portion 120*a* of that member in the depicted vertical cross-section view), which is preferably integrally formed as part of tank section 101 to serve as a base upon which the tank may be rested in an upright position.

Tank 100 is also depicted as including a means for separating (shown as 107 in FIG. 1) the tank into the aforementioned first and second interior portions (103 and 106 respectively); where means for separating 107 spans the interior of tank 100 and is made of a flexible material.

In practice, means for separating 107 can be realized by, for example, a flexible diaphragm (single of multiple layer), bladder or some other application specific membrane that separates a the expansion tank into two chambers.

Still further with reference to FIG. 1, according to a preferred embodiment of the invention described in incorporated patent application Ser. No. 08/602,249, now abandoned, tank 100 includes means for securing (shown as 110 in FIG. 1) the means for separating 107 (within tank 100) via a joint formed between first molded plastic tank section 101 and second molded plastic tank section 104.

For the applications contemplated by the instant invention it is desirable that the separate fluid chambers be formed using a material that is not permeable to either of the fluids being introduced into the tank and which allows one of the chambers to be precharged with an expansion fluid to exert a predetermined back pressure on means for separating 107.

Figure 2:
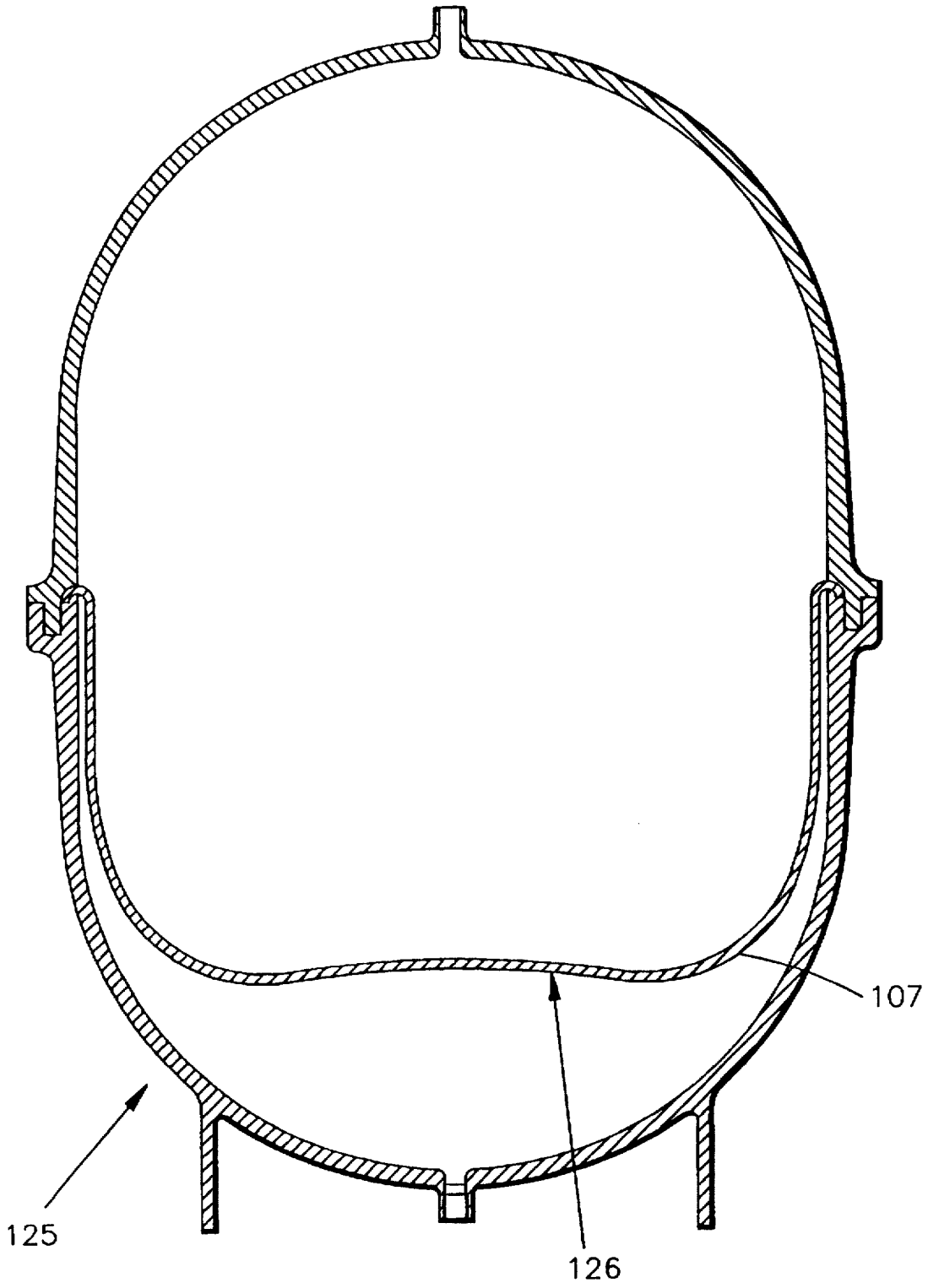
FIG. 2 is a vertical cross-section view of the tank depicted in FIG. 1 after being pre-charged, including means for separating shown deformed by the expansion fluid used to pre-charge the tank.

A vertical cross-section view of the tank depicted in FIG. 1 after being pre-charged is shown in FIG. 2, where means for separating 107 in tank 125 is shown deformed by expansion fluid 126 used to pre-charge the tank.

Having described an exemplary expansion tank in which the instant invention may be practiced, it should be recalled from the Summary of the Invention as set forth hereinbefore that according to the invention, a "volatile" fluid is used at least in part as the expansion fluid in an expansion tank included in a fluid storage system (such as the exemplary tank shown and described with reference to FIG. 1); as opposed to the utilization of a pure ideal gas expansion fluid, such as air as is used in conventional expansion tanks.

The volatile fluid, whether pure or combined with an ideal gas to temper the expansion fluids sensitivity to temperature, can be used to realize the pressure "vapor spring" contemplated by the invention.

This will be demonstrated hereinafter with reference to FIG. 3 and FIG. 4; first, however, the principles of the invention should be understood and can be explained with reference to the following example.

Initially, assume that an expansion tank in a fluid storage system is pre-charged with a small amount of fluid. This could be accomplished, again for example, by introducing the pre-charge fluid into an expansion tank like tank 100 via connection 102 (shown in FIG. 1); and than sealing that portion of the tank by closing a valve.

Assume further that the fluid vapor pressure in tank section 103 in FIG. 1 is 5 psig at 70 degrees F. Thus if the tank is at 70 degrees F. the vapor space would stabilize at 5 psig.

As a fluid expands into the tank (for example in the RO case, if water expands into tank 100 via connection 105) and displaces the membrane (means for separating 107), enough vapor would condense to maintain a system pressure at 5 psig. The opposite would occur if water left the tank. As the vapor volume increases, enough liquid would evaporate to maintain the vapor at 5 psig. During extremely rapid volume changes, there may be some lag in the process.

As long as the temperature remains constant and there is liquid and vapor present, the equilibrium pressure will not change. Factors that can change the pressure are the temperature, the amount of fluid in the charge, and the presence of non-condensing gases therein.

Figure 3:
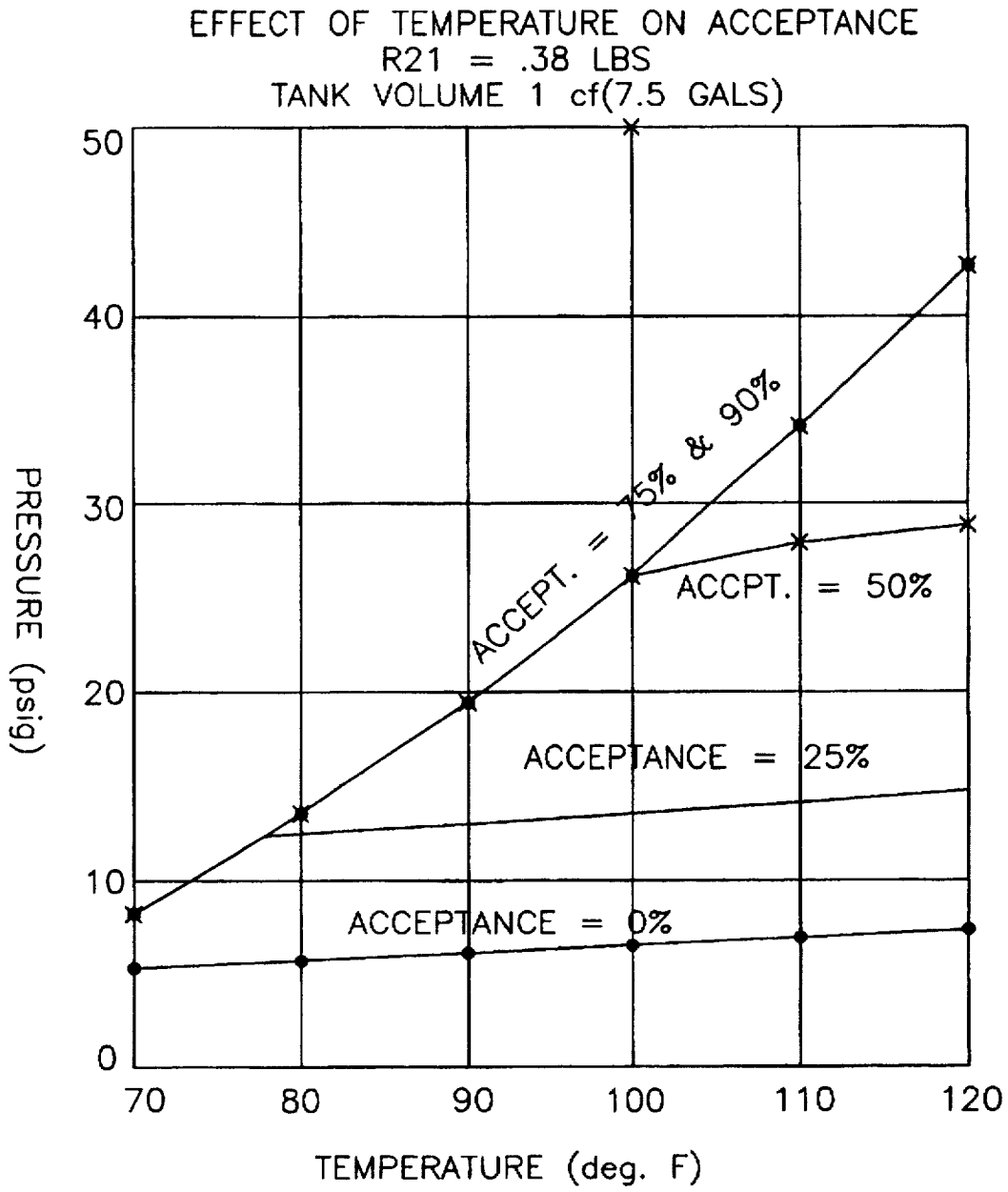
FIG. 3 is a graph depicting pressure versus fluid temperature when using a commercially available refrigerant (R11) as an expansion fluid in an illustrative embodiment of the invention.

Reference should now be made to FIG. 3 which is a graph depicting pressure versus fluid temperature when using a commercially available refrigerant R11 (used only as a vehicle for illustrating the principles of the invention) as the fluid charge (i.e., as the expansion fluid) for values of acceptance from 0–90 percent.

The assumptions made are that the tank and fluid temperatures are the same and the total tank volume is 1 cubic foot (7.5 gallons). The refrigerant side of the means for separating in the expansion tank was filled with 0.38 pounds of fluid. This amount resulted in a back pressure of 5 psig at 70 degrees F. on the means for separating, the minimum needed to operate a faucet in an RO system.

At 70 degrees F. the tank pressure varies from 5 to 8.5 psig as the acceptance varies from 0–90 percent. Even at 90 degrees F. the pressure only varies from 6–18 psig through the same range of acceptance. By comparison, if the tank were precharged with air as the expansion fluid, the pressure would vary from 6 to over 190 psig at 90 degrees F. over the same range of acceptance. At 120 degrees F., pressures remain below 30 psig at acceptances of 50 percent and below. This plot shows dramatically the potential of the invention. An RO system can operate at a wide range of ambient conditions (for example, 70–90 degrees F.) and never exceed half the current typical RO system maximum tank pressure to help avoid the serious adverse affects on upstream purification processes and recovery rates as experienced using prior art fluid storage systems that use an ideal gas as an expansion fluid.

Another approach contemplated by the invention, in a preferred embodiment thereof, is that of using an expansion fluid that is a combination of a saturated fluid and a non-condensing gas, such as air, to precharge the expansion tank. By using a non-condensing gas together with a saturated fluid, the performance of the fluid storage system can be tailored to perform between a system that uses a pure saturated fluid and one that uses, a pure ideal gas, such as air.

Those skilled in the art will readily appreciate that FIG. 3 also illustrates that by limiting the amount of volatile fluid, at low acceptance/high temperature all of the volatile fluid will be in vapor form and thus the pressure will be less sensitive to temperatures. Thus, with 0.38 lbs. of R11, at zero acceptance, all of the fluid is in the vapor state at temperatures above 62 degrees F. At 25% acceptance at temperatures above 78 degrees F. the fluid is in a vapor state (all the liquid has evaporated).

Figure 4:
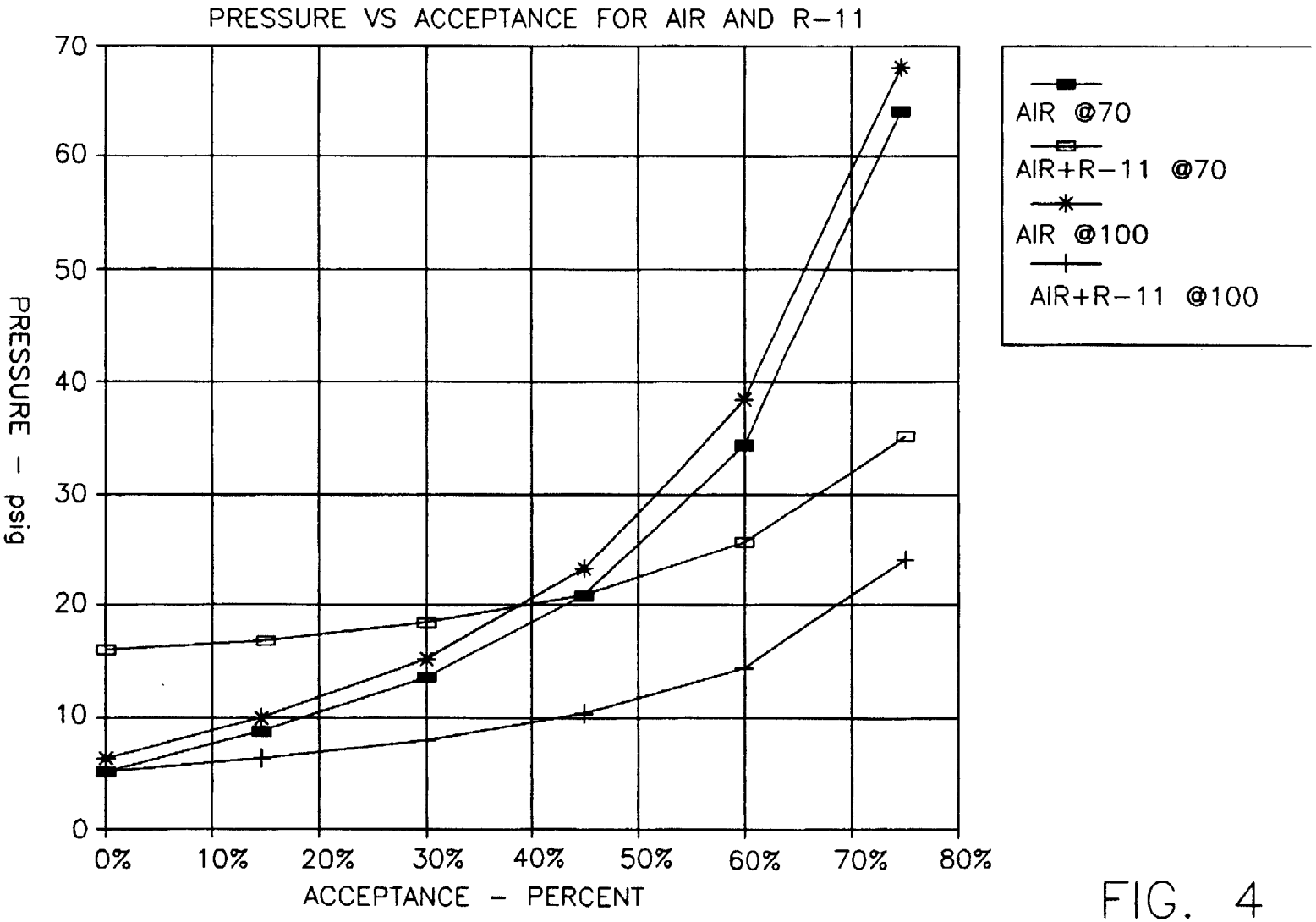
FIG. 4 is a graph that compares a pure air charge versus a charge of using an expansion fluid that combines air and R11.

A better understanding of how such a system would perform may be seen with reference to FIG. 4. FIG. 4 compares a pure air charge versus a charge of using an expansion fluid that combines air and R11. Comparing the two cases at 70 degrees F., at zero percent acceptance, both systems are at 5 psig. At 75 percent acceptance, however, the air/R11 system is at 25 psig while the pure air system is at 65 psig. Even at higher temperature, the air/R11 system is only 35 psig while the pure air system is, at 68 psig.

Clearly FIG. 4 demonstrates that the performance of the fluid storage system can be tailored by using a non-condensing gas together with a saturated fluid as the pre-charge expansion fluid.

A more detailed analysis of exemplary applications served by the instant invention, operating conditions that would have to be met in the context of such applications, and further graphs demonstrating the benefits of the invention, are presented hereinafter with reference to FIGS. 5–10.

FIG. 5 is a table that lists three exemplary applications in which the instant invention may be beneficially put to use. The applications are characterized as either an "inventory" type system or a "cushioned" system (previously defined herein by way of example). More particularly, in an inventory type system, such as a RO or well system, the storage system is storing product; while in a cushion system the storage system is accommodating then expansion and contraction of the working fluid.

In applying the principles of the invention along with the methods and apparatus taught and claimed herein, two parameters are important; the pressure and temperature operating ranges of the fluid storage system.

Pressure is important because if more than anything else, it enters into the selection of the expansion fluid to use. In general, expansion fluids with boiling points near room temperature (50–100 degrees F.) are preferred for the exemplary applications discussed herein. In general, a small temperature range is also desired so that the pressure remains relatively constant.

In conventional systems using air or other ideal gaseous fluid as an expansion fluid, pressure increases greatly as the storage volume is compressed. On the other hand, as the temperature changes, the pressure increase is modest. If a pure two phase (liquid and gas) expansion fluid is used, which is contemplated by one aspect of the present invention, the pressure remains relatively constant during volume changes (relative to the pressure changes that would be experienced using an ideal gas as an expansion fluid); however the pressure can change rapidly with an increase in temperature.

The two approaches discussed hereinabove, pure ideal gas versus two-phase fluid have differing affects on the volume, pressure and temperature relationships within a given system. A further aspect of the invention is directed to a fluid storage system using a hybrid of the two.

From the table shown in FIG. 5 it appears that R/O or well systems are ideal applications for the invention because of their relatively narrow operating temperature ranges; however significant application can also be found in the case of the exemplary hydronic system. Should the width of the temperature operating range of a given system prove problematic one could, for example, separate the fluid being stored from the heating source to bring down the temperature range of the fluids stored down into a narrower band.

In selecting any particular expansion fluid to be used for the exemplary applications shown in FIG. 5 one criteria could be to choose a fluid having a boiling point well within the range of the typical temperatures experienced. "Boiling point" is defined herein to mean the temperature at which a fluid boils at normal atmospheric pressure, i.e., zero psig. Other criteria could include selecting a fluid that is safe in the context of the system in which it is used.

For example, an expansion fluid chosen for use in an inventory system storing drinking water would ideally be non-toxic to avoid contamination if the expansion fluid and working fluid were ever to come in contact with one another. The expansion fluid being non-flammable becomes important in certain operating environments since a flammable fluid otherwise chosen to boil at or near room temperature would produce a flammable vapor in the event of a leak. Other applications might tolerate some degree of toxicity, etc., as determined on a case by case basis depending on the application of the fluid storage system.

Figure 6:
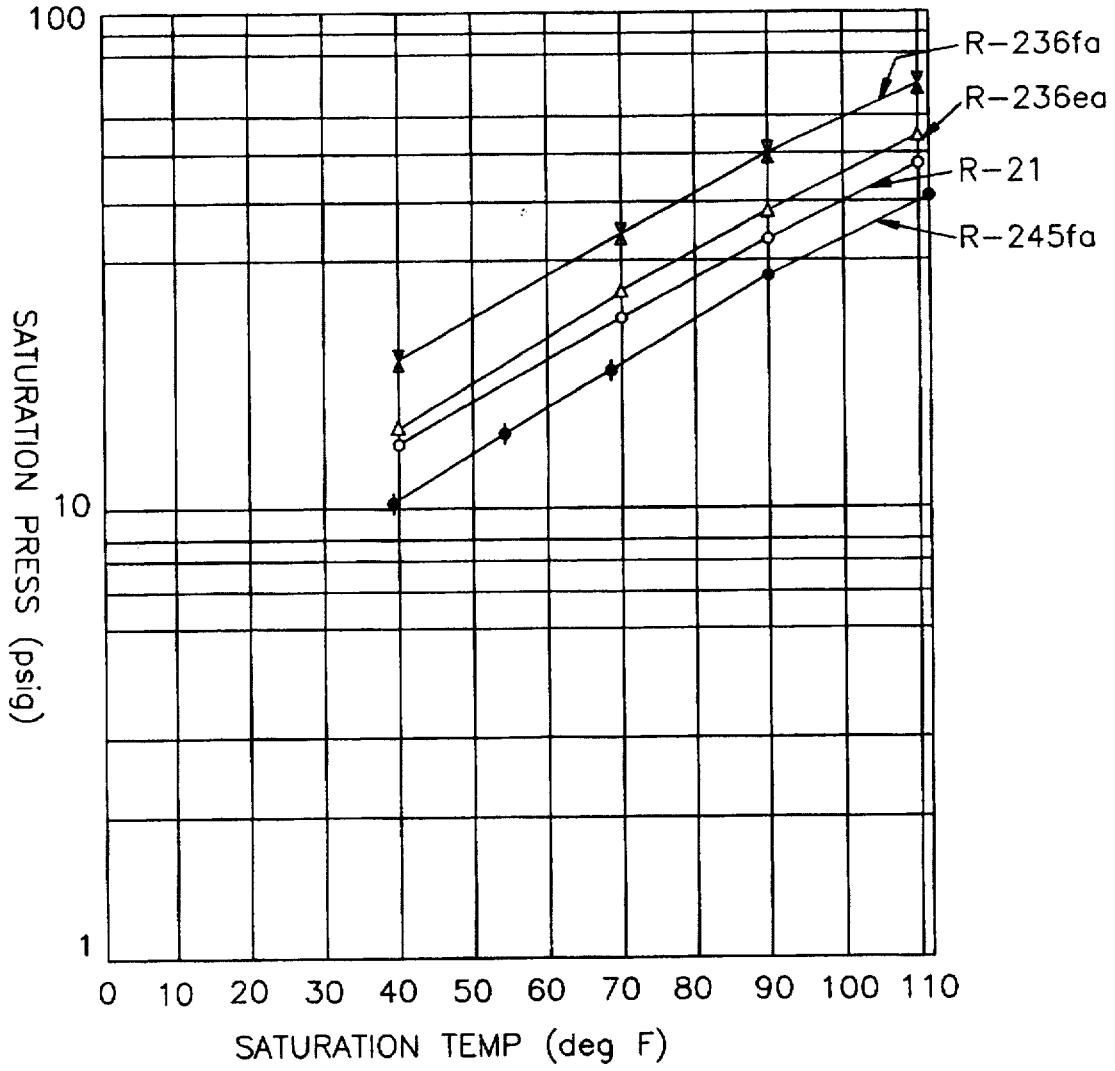
FIG. 6 which is graph depicting the saturation curves for four exemplary volatile expansion fluids (R-245*fa*, R-236*ea*, R-236 *fa* and R-21), all have boiling points in the 40–100 degree F. range.

Several fluids chosen to further illustrate the principles of the invention and its advantages (and not because the use of one is favored over the use of another fluid whether or not discussed herein) are depicted in FIG. 6 which is a plot of saturation curves for the exemplary identified fluids. These fluids (R-245*fa*, R-236*ea*, R-236 *fa* and R-21) all have boiling points in the 40–100 degree F. range. The fluids plotted are all refrigerants; however the invention more generally contemplates the use of a volatile fluid (as defined hereinbefore) in whole or in part to constitute an expansion fluid; whether or not the volatile fluid is a refrigerant.

For the sake of illustration only, one of these fluids (R-245*fa*, sometimes referred to hereinafter simply as "245*fa*"), was evaluated taken alone, in combination with air and in comparison with air alone, to be able to illustrate the relationship between temperature, tank pressure, and acceptance for various samples of a pure volatile liquid expansion fluid (like the R-245*fa*), a pure ideal gas expansion fluid (like the air) and combinations of a volatile liquid and an ideal gas.

Figure 7:
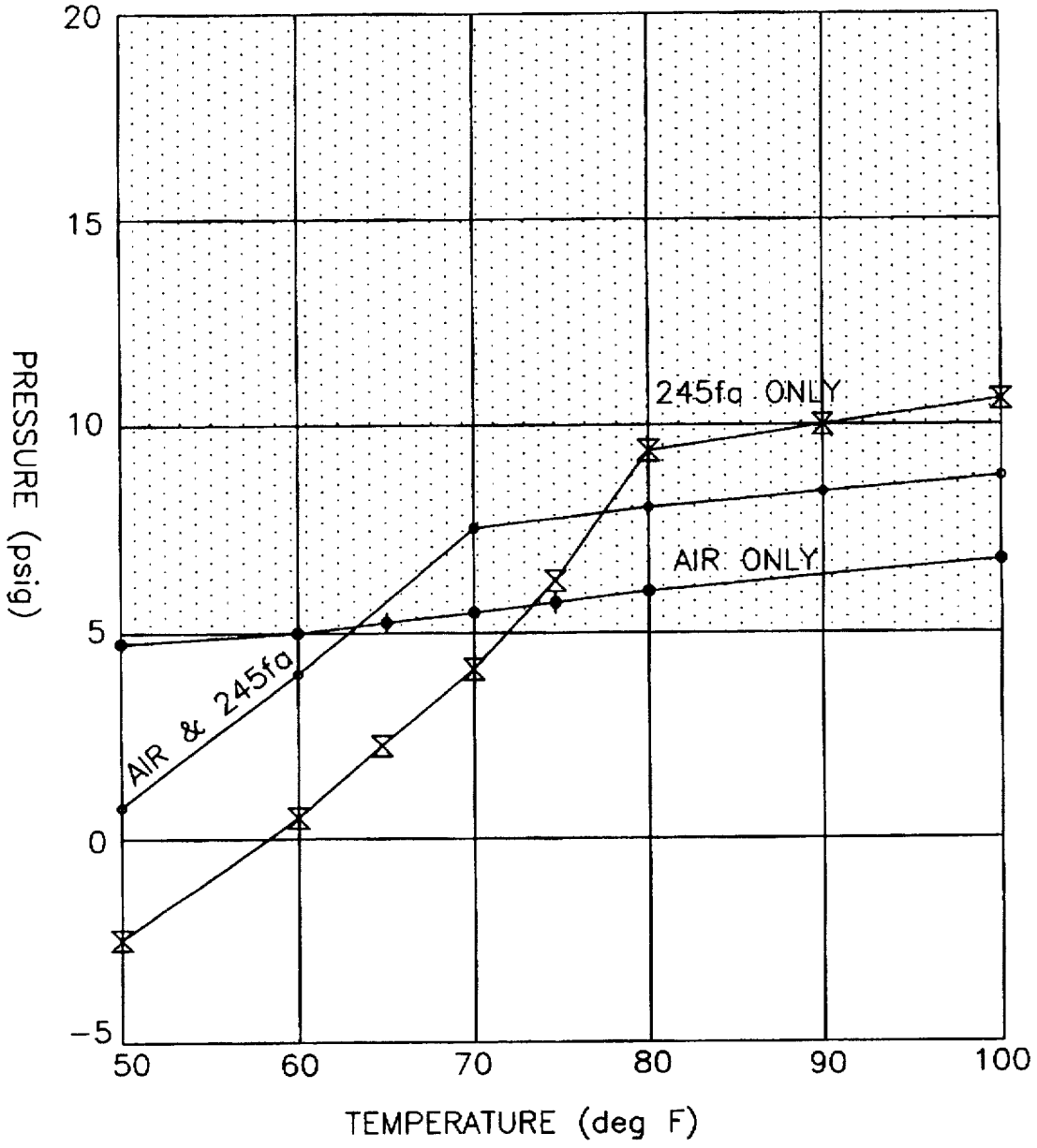
FIG. 7 is a graph which depicts the relationship between temperature, tank pressure, and acceptance for samples of R-245*fa*, air and R-245*fa* combined with air, showing what happens to tank pressure as the temperature varies from 50 to 100 degrees F. at zero percent acceptance.
Figure 8:
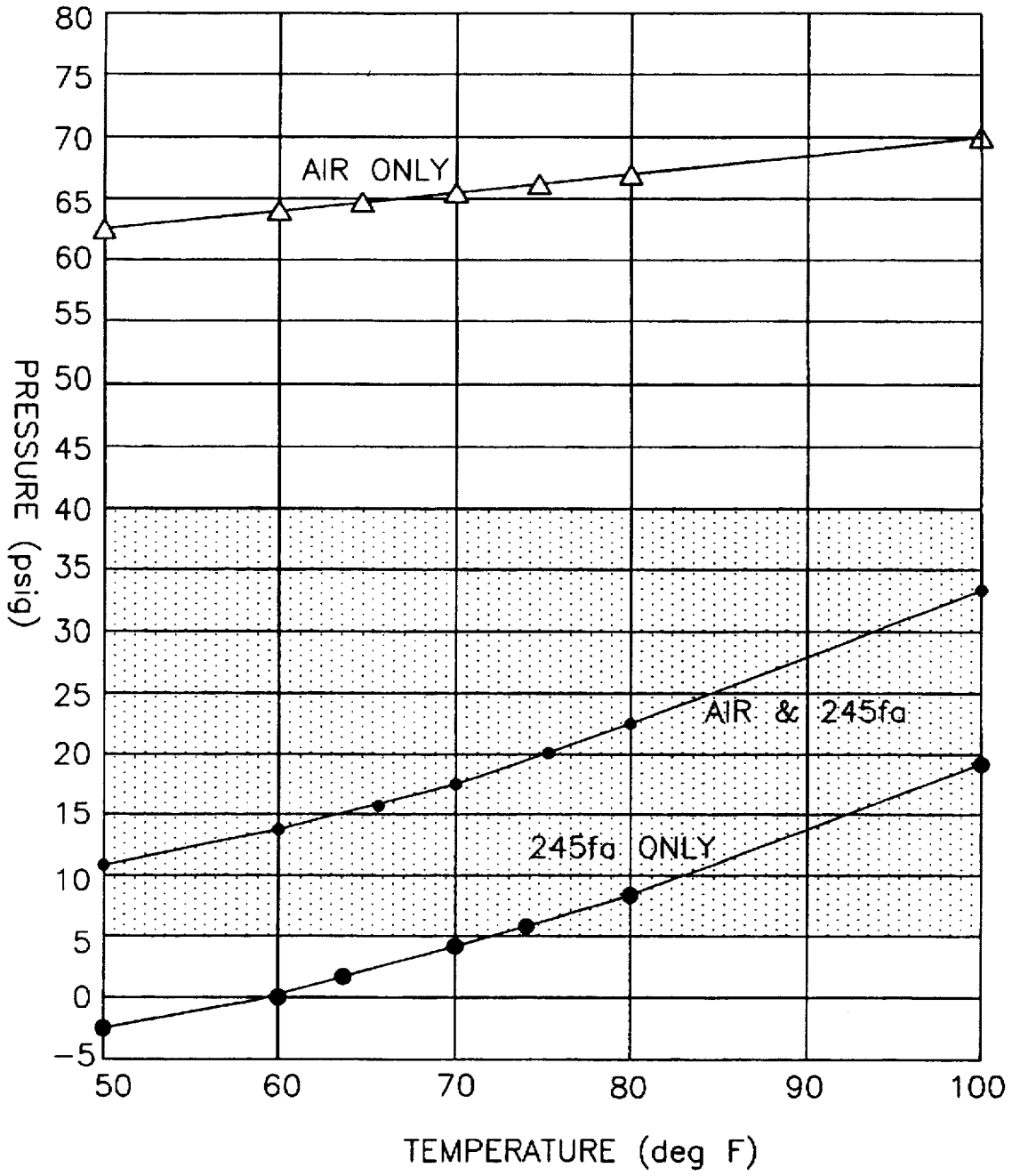
FIG. 8 is a graph which depicts the relationship between temperature, tank pressure, and acceptance for samples of R-245*fa*, air and R-245*fa* combined with air, showing what happens to tank pressure as the temperature varies from 50 to 100 degrees F. at seventy five percent acceptance.

In particular, FIG. 7 and FIG. 8 are graphs which depict the aforementioned relationship between temperature, tank pressure, and acceptance for samples of R-245*fa*, air and R-245*fa* combined with air. More particularly, FIG. 7 shows what happens to tank pressure as the temperature varies from 50 to 100 degrees F. at zero percent acceptance. With the pure fluid (245*fa* only) the pressure is subatmospheric at 50 degrees F., about 5 psig at room temperature, and peaks at about 10 psig when it becomes pure vapor at 80 degrees F. Air shows a pressure of 5 psig at 60 degrees F. which increases slightly with temperature. The mixture of air and 245*fa* increases the pressure at low temperature when compared to 245*fa* alone, making (for example) an RO system workable down to 60 degrees F. The dramatic change in slope at 70 degrees F. occurs because both the 245*fa* and air are in the gaseous state.

FIG. 8 shows the same variables; however, for an acceptance of 75 percent. The shaded region is the acceptable range of operation for a typical RO system which is used as an exemplary system hereinafter to explain the remaining principles of the invention. As shown in FIG. 8, the air only case is, well above this region. In fact, the maximum practical acceptance is 60 percent for air.

If pure 245*fa* is used, it can be seen that the acceptance can be much higher than 75 percent; however, an RO system would not operate much below 70 degrees F. The mixture of air and 245*fa* shows an acceptable pressure throughout the temperature range. In fact, its pressure will still be reasonable at a higher acceptance. Not as obvious is the fact that an RO system will be more efficient during the recovery part of the cycle because the pressure on the downstream side of the purification membrane will be lower. For the sake of completeness it should be noted that FIG. 7 and FIG. 8 were prepared assuming 0.175 pounds of 245*fa* and 0.007 pounds of air. These assumptions were made to allow the exemplary RO system to operate below 70 degrees F.

Figure 9:
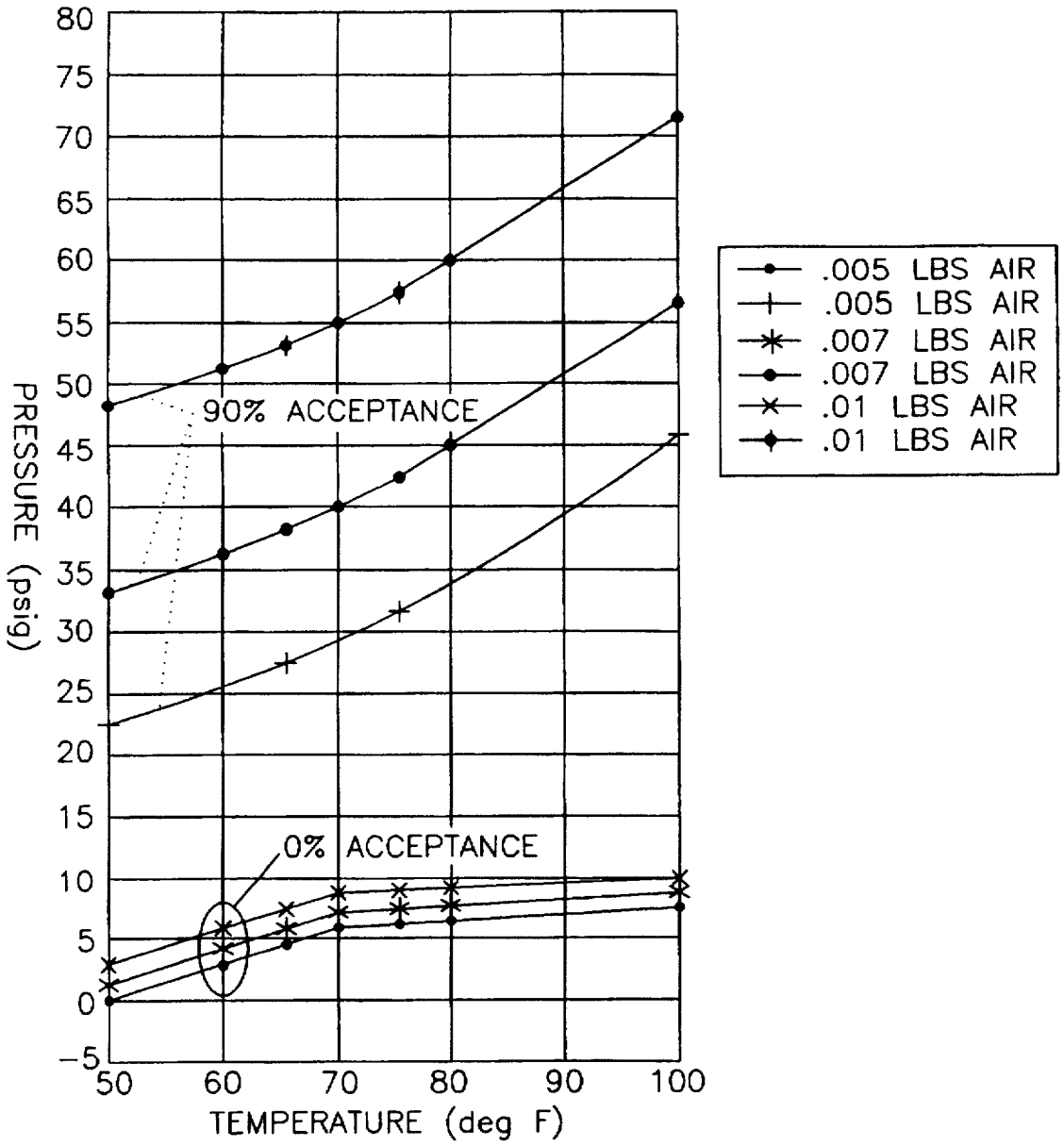
FIG. 9 is a graph illustrating the effect the quantity of air and 245*fa* have on an exemplary RO system.
Figure 10:
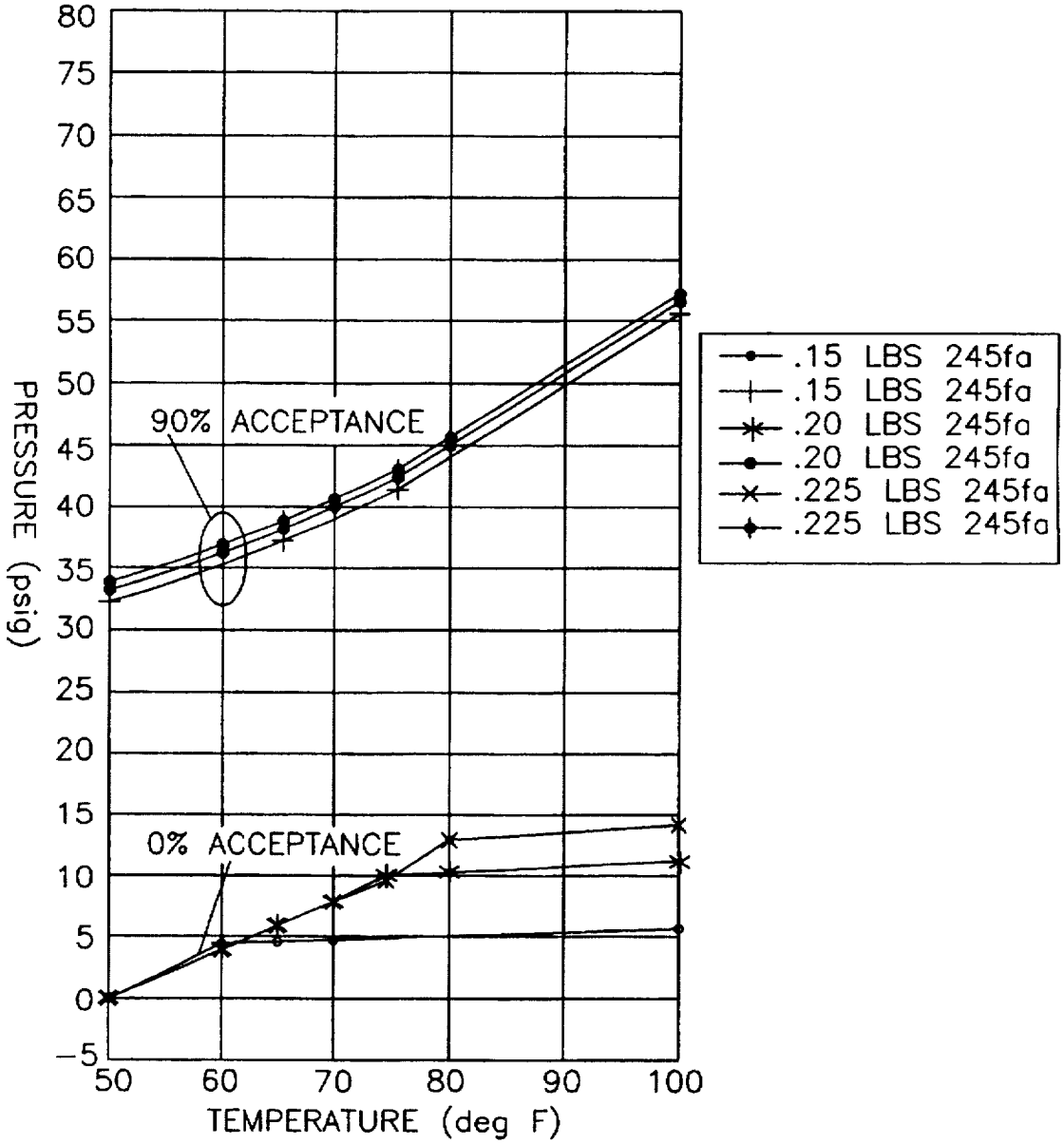
FIG. 10 is also a graph illustrating the effect the quantity of air and 245*fa* have on an exemplary RO system; however in FIG. 10 the quantity of air is kept constant at 0.007 pounds; while the quantity of 245*fa* varies from 0.15 to 0.225 pounds. There are two sets of curves in FIG. 10, one set corresponding to zero percent acceptance and the other to 90 percent acceptance.

The effect the quantity of air and 245*fa* have on the exemplary RO system is illustrated in FIG. 9 and FIG. 10, respectively. In FIG. 9 the quantity of 245*fa* was kept constant at 0.175 pounds; while the quantity of air was varied from 0.005 to 0.010 pounds. There are two sets of curves in each of FIG. 9 and FIG. 10; one set corresponding to zero percent acceptance and the other to 10 percent acceptance. With reference again to FIG. 9, it is apparent from the upper set of curves (90 percent acceptance), the less the amount of air used the better. From the lower set of curves (zero percent acceptance) it can be seen that the function of the air is to simply raise the initial pressure to a useful level. By analyzing the figures described hereinbefore it becomes apparent that, although somewhat arbitrary, 0.007 pounds of air seems reasonable to use in the exemplary RO system for which fluid constituent choices are being made in the instant example.

The effect of the quantity of 245*fa* can be seen in FIG. 10. In FIG. 10 the quantity of air was kept constant at 0.007 pounds; while the quantity of 245*fa* was varied from 0.15 to 0.225 pounds. Surprisingly, there is little effect from fluid quantity on the system. At high acceptance there is virtually no effect since the fluid is saturated. A low acceptance the quantity of fluid determines at what temperature the fluid reaches the all vapor state. At 0.15 pounds, the vapor state is reached at 60 degrees F.; while at 0.225 pounds it occurs at 80 degrees F. For the exemplary RO system application, 0.175 pounds of 245*fa* seems reasonable to use since it keeps the pressure between 5 and 10 psig in the range of interest.

Figure 11:
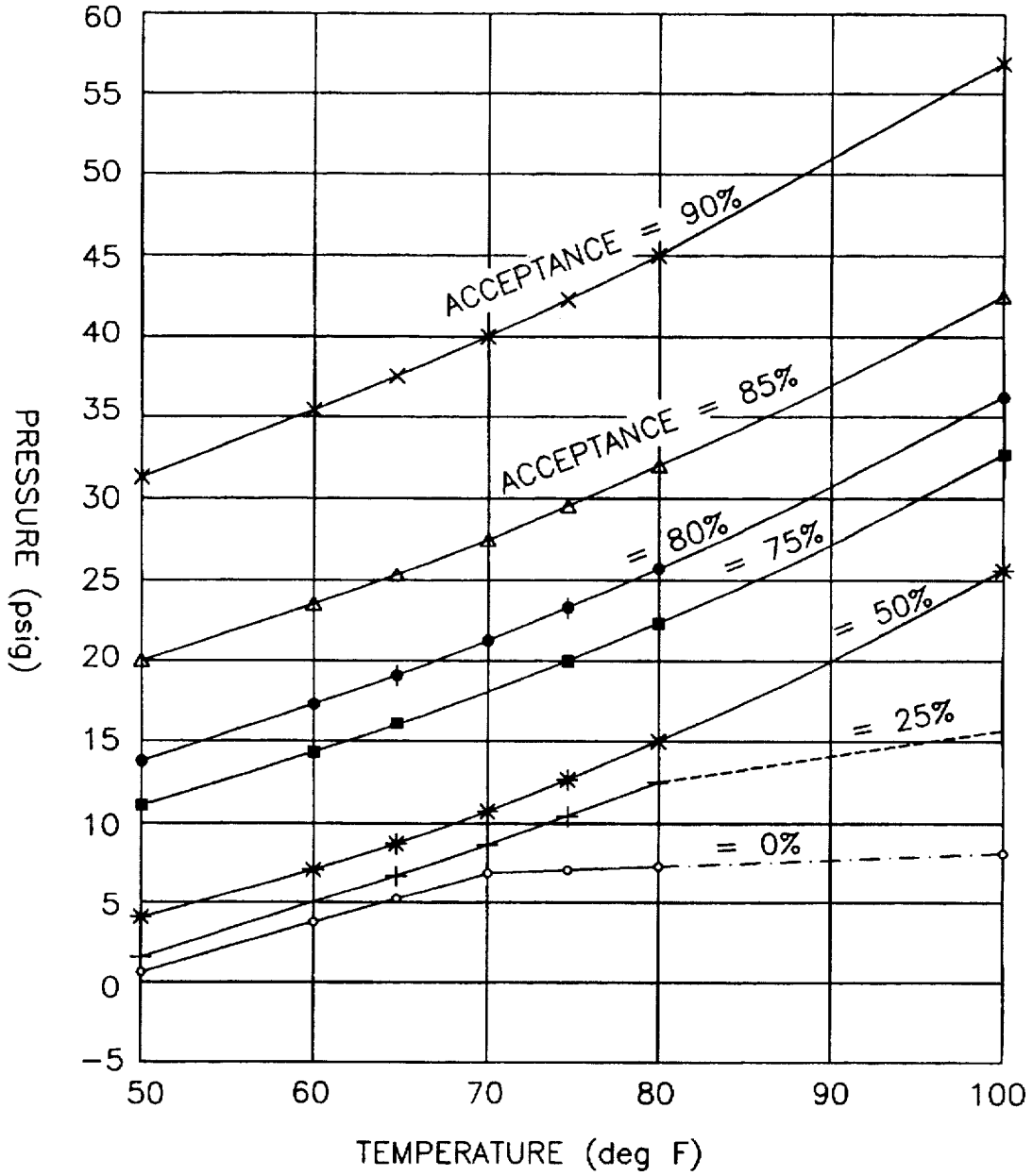
FIG. 11 is a graph which plots temperature versus pressure at various levels of acceptance in a fluid storage system using an expansion fluid consisting of 0.175 pounds of 245*fa* combined with 0.007 pounds of air.

Reference should now be made to FIG. 11 which shows a fluid storage system with 0.175 pounds of 245*fa* and 0.007 pounds of air plotted as temperature versus pressure. As can be seen from FIG. 11, this system would work well for an RO system with a minimum pressure of 5 psig at about 60 degrees F. and a maximum pressure of 40 psig at 95 degrees F. and an acceptance of 85%, thereby demonstrating the principles of the invention.

What has been described in detail hereinabove are methods, apparatus and fabrication techniques which meet all of the aforestated objectives. As previously indicated, those skilled in the art will recognize that the foregoing description has been presented for the sake of illustration and description only. It is not intended to be exhaustive or to limit the invention to the precise form disclosed, and obviously many modifications and variations are possible in light of the above teaching.

The embodiments and examples set forth herein were presented in order to best explain the principles of the instant invention and its practical application to thereby enable others skilled in the art to best utilize the instant invention in various embodiments and with various modifications as are suited to the particular use contemplated.

In view of the above it is, therefore, to be understood that the claims appended hereto are intended to cover all such modifications and variations which fall within the true scope and spirit of the invention.

What is claimed is:

1. A method for increasing the working fluid storage capacity of a precharged fluid storage system, wherein said system includes a fluid containment vessel, flexible means for separating the interior of said vessel into (a) a first portion for storing an expansion fluid used to precharge said vessel at ambient temperature to a predetermined back pressure exerted on said means for separating and into (b) a second portion for storing said working fluid, comprising the steps of:

(a) precharging said vessel by introducing a volatile expansion fluid into the first portion of said vessel; and (b) introducing said working fluid into the second portion of said vessel to displace said means for separating and cause said volatile expansion fluid to at least in part condense to reduce the increase of the back pressure of said volatile expansion fluid on said means for separating in comparison with the back pressure that would be exerted on said means for separating using an ideal gas expansion fluid, to thereby permit additional working fluid to be introduced into said vessel.

2. A method as set forth in claim 1 further comprising the step of combining said volatile expansion fluid with a predetermined amount of an ideal gas to modulate the boiling point of said expansion fluid.

3. A method set forth in claim 2 wherein said ideal gas is air.

4. A method as set forth in claim 2 further comprising the step of limiting the amount of the volatile expansion fluid combined with said ideal gas so that the mixture is less sensitive to temperature change.

5. A method as set forth in claim 1 wherein said volatile fluid is a refrigerant.

6. A method as set forth in claim 1 wherein said volatile fluid is non-toxic.

7. A method as set forth in claim 1 wherein said volatile fluid is non-flammable.

8. A method for holding down pressure increases in a precharged fluid storage system for a given volume of acceptance, wherein said system includes a fluid containment vessel, flexible means for separating the interior of said vessel into (a) a first portion for storing an expansion fluid used to precharge said vessel at ambient temperature to a predetermined back pressure exerted on said means for separating and into (b) a second portion for storing said working fluid, comprising the steps of:

(a) precharging said vessel by introducing a volatile expansion fluid into the first portion of said vessel; and (b) introducing said working fluid into the second portion of said vessel to displace said flexible means for separating and cause said volatile expansion fluid to at least in part condense and exert a back pressure on said means for separating which is less than the back pressure that would be exerted on said means for separating by an ideal gas expansion fluid for the volume of working fluid accepted, to thereby hold down pressure increases in said vessel for a given volume of acceptance.

9. A method as set forth in claim 8 further comprising the step of combining said volatile expansion fluid with a predetermined amount of an ideal gas to modulate the boiling point of said expansion fluid.

10. A method set forth in claim 9 wherein said ideal gas is air.

11. A method as set forth in claim 9 further comprising the step of limiting the amount of the volatile expansion fluid combined with said ideal gas so that the mixture is less sensitive to temperature change.

12. A method as set forth in claim 8 wherein said volatile fluid is a refrigerant.

13. A method as set forth in claim 8 wherein said volatile fluid is non-toxic.

14. A method as set forth in claim 8 wherein said volatile fluid is non-flammable.

15. Apparatus for increasing the working fluid storage capacity of a precharged fluid storage system, comprising:

(a) a fluid containment vessel;

(b) flexible means for separating the interior of said vessel into (1) a first portion for storing an expansion fluid used to precharge said vessel at ambient temperature to a predetermined back pressure exerted on said means for separating and into (2) a second portion for storing said working fluid;

(c) a volatile expansion fluid located in said first portion of said vessel; and (d) a working fluid located in said second portion of said vessel which displaces said means for separating to cause said volatile expansion fluid to at least in part condense and act as a pressure spring to reduce the increase of the back pressure of said volatile expansion fluid on said means for separating in comparison with the back pressure that would be exerted on said means for separating using an ideal gas expansion fluid, to thereby permit additional working fluid to be introduced into said vessel.

16. Apparatus as set forth in claim 15 further comprising a predetermined amount of an ideal gas combined with said volatile expansion fluid modulate the boiling point of said expansion fluid.

17. Apparatus as set forth in claim 16 wherein said ideal gas is air.

18. Apparatus as set forth in claim 16 wherein the amount of the volatile expansion fluid combined with said ideal gas is limited so that the mixture is less sensitive to temperature change.

19. Apparatus as set forth in claim 15 wherein said volatile fluid is a refrigerant.

20. Apparatus as set forth in claim 15 wherein said volatile fluid is non-toxic.

21. Apparatus as set forth in claim 15 wherein said volatile fluid is non-flammable.

22. Apparatus for holding down pressure increases in a precharged fluid storage system for a given volume of acceptance, comprising:

(a) a fluid containment vessel;

(b) flexible means for separating the interior of said vessel into (1) a first portion for storing an expansion fluid used to precharge said vessel at ambient temperature to a predetermined back pressure exerted on said means for separating and into (2) a second portion for storing said working fluid;

(c) a volatile expansion fluid located in said first portion of said vessel; and (d) a working fluid located in said second portion of said vessel which displaces said means for separating to cause said volatile expansion fluid to at least in part condense and act as a pressure spring to exert a back pressure on said means for separating which is less than the back pressure that would be exerted by an ideal gas expansion fluid for the volume of working fluid accepted, to thereby hold down pressure increases in said vessel for a given volume of acceptance.

23. Apparatus as set forth in claim 22 further comprising a predetermined amount of an ideal gas combined with said volatile expansion fluid modulate the boiling point of said expansion fluid.

24. Apparatus as set forth in claim 23 wherein said ideal gas is air.

25. Apparatus as set forth in claim 23 wherein the amount of the volatile expansion fluid combined with said ideal gas is limited so that the mixture is less sensitive to temperature change.

26. Apparatus as set forth in claim 22 wherein said volatile fluid is a refrigerant.

27. Apparatus as set forth in claim 22 wherein said volatile fluid is non-toxic.

28. Apparatus as set forth in claim 22 wherein said volatile fluid is non-flammable.

29. A precharged fluid storage system, comprising:

(a) a fluid containment vessel for separately storing both a working fluid and an expansion fluid within said vessel; and (b) a pressure vapor spring that utilizes a volatile expansion fluid to permit additional working fluid to be introduced into said vessel at a given pressure when compared with the amount of working fluid that could be accepted using an ideal gas expansion fluid at said given pressure.

30. A precharged fluid storage system, comprising:

(a) a fluid containment vessel for separately storing both a working fluid and an expansion fluid within said vessel; and (b) a pressure vapor spring that utilizes a volatile expansion fluid to reduce pressure increases within said vessel for a given volume of acceptance when compared with the use of an ideal gas expansion fluid in said vessel for said given volume of acceptance.

31. A process for adjusting the rate of pressure change, within a fluid containment vessel, within a prespecified pressure range at ambient temperature, as the volume of working fluid stored in said vessel changes, comprising the steps of:

(a) separating the interior of said vessel into two portions utilizing a flexible means for separating;

(b) precharging said fluid containment vessel by introducing at least some volatile expansion fluid into one of the interior portions of said vessel; and (c) introducing a working fluid into the other interior portion of said vessel to displace said means for separating and cause said volatile expansion fluid to at least in part condense to reduce the increase of the back pressure of said volatile expansion fluid on said means for separating as the volume of working fluid increases.

32. A process as set forth in claim 31 further comprising the step of removing working fluid from said other interior portion of said vessel to relax displacement of said means for separating and cause said volatile expansion fluid to at least in part boil.

33. A method as set forth in claim 32 further comprising the step of combining said volatile expansion fluid with a predetermined amount of an ideal gas to modulate the boiling point of said expansion fluid.

34. A method set forth in claim 33 wherein said ideal gas is air.

35. A method as set forth in claim 33 further comprising the step of limiting the amount of the volatile expansion fluid combined with said ideal gas so that the mixture is less sensitive to temperature change.

36. A method as set forth in claim 32 wherein said volatile fluid is a refrigerant.

37. A method as set forth in claim 32 wherein said volatile fluid is non-toxic.

38. A method as set forth in claim 32 wherein said volatile fluid is non-flammable.

39. A process for adjusting the rate of pressure change, within a fluid containment vessel, within a prespecified pressure range at ambient temperature, as the temperature of working fluid stored in said vessel changes, comprising the steps of:

(a) separating the interior of said vessel into two portions utilizing a flexible means for separating;

(b) precharging said fluid containment vessel by introducing at least some volatile expansion fluid into one of the interior portions of said vessel; and (c) introducing a working fluid into the other interior portion of said vessel to displace said means for separating and cause said volatile expansion fluid to at least in part condense to reduce the increase of the back pressure of said volatile expansion fluid on said means for separating as the temperature of the working fluid introduced increases.

40. A process as set forth in claim 39 further comprising the step of lowering the temperature of said working fluid to relax displacement of said means for separating and cause said volatile expansion fluid to at least in part boil.

* * * * *